US011305958B2

(12) United States Patent
Kim et al.

(10) Patent No.: US 11,305,958 B2
(45) **Date of Patent: *Apr. 19, 2022**

(54) ROLL MANUFACTURING METHOD AND MANUFACTURING DEVICE

(71) Applicant: Corning Precision Materials Co., Ltd., Chungcheongnam-do (KR)

(72) Inventors: Ki Nam Kim, Chungcheongnam-do (KR); Shin Kim, Chungcheongnam-do (KR); Mun Hwan Seol, Chungcheongnam-do (KR); Dong Young Cho, Chungcheongnam-do (KR)

(73) Assignee: Corning Precision Materials Co., Ltd.

( * ) Notice: Subject to any disclaimer, the term of this patent is extended or adjusted under 35 U.S.C. 154(b) by 128 days.

This patent is subject to a terminal disclaimer.

(21) Appl. No.: 15/034,054

(22) PCT Filed: Nov. 4, 2014

(86) PCT No.: PCT/KR2014/010479
§ 371 (c)(1),
(2) Date: May 3, 2016

(87) PCT Pub. No.: WO2015/065145
PCT Pub. Date: May 7, 2015

(65) Prior Publication Data

US 2016/0280493 A1 Sep. 29, 2016

(30) Foreign Application Priority Data

Nov. 4, 2013 (KR) ..... 10-2013-0133104

(51) Int. Cl.
*B65H 23/188* (2006.01)
*B65H 35/02* (2006.01)

(52) U.S. Cl.
CPC ..... *B65H 23/188* (2013.01); *B65H 35/02* (2013.01); *B65H 2301/441* (2013.01); *B65H 2515/50* (2013.01); *B65H 2801/61* (2013.01)

(58) Field of Classification Search
CPC ..... B65H 23/188; B65H 35/02; B65H 2301/441; B65H 2515/50; B65H 2801/61; C03B 17/00; C03B 17/06
See application file for complete search history.

(56) References Cited

U.S. PATENT DOCUMENTS 3,827,547 A * 8/1974 Nixon ..... C03B 35/24 198/721
4,938,404 A 7/1990 Helms et al.
(Continued)

FOREIGN PATENT DOCUMENTS

EP 2226254 A1 9/2010
JP 2011200843 A 10/2011
(Continued)

OTHER PUBLICATIONS

EP 2226254 machine translation; KOCH; Packaging machine for packing of goods and/or package units i.e. beverage bottles, has rod or roller-like guiding elements for guiding packing webs, where one of guiding elements is designed as ultrasonic air bearing; Sep. 8, 2010. (Year: 2010).*
(Continued)

*Primary Examiner* — Queenie S Dehghan
(74) *Attorney, Agent, or Firm* — Lerner, David, Littenberg, Krumholz & Mentlik, LLP

(57) ABSTRACT

The present invention provides a roll manufacturing method characterized by comprising: a shaping step of shaping a base material into a web; a transferring step of transferring the shaped web; and a winding step of winding the transferred web into a roll. In addition, the present invention provides a roll manufacturing device characterized by com-
(Continued)

prising: a shaping unit for shaping a base material into a web; a transferring unit for transferring the shaped web; and a winding unit for winding the transferred web into a roll.

17 Claims, 6 Drawing Sheets

(56) References Cited

U.S. PATENT DOCUMENTS 6,455,982 B1* 9/2002 Hashimoto ..... B65G 35/005 310/328
2007/0031600 A1* 2/2007 Devitt ..... B05C 13/00 427/248.1
2011/0011704 A1* 1/2011 Isobe ..... B65G 54/00 198/752.1
2011/0177290 A1* 7/2011 Tomamoto ..... B32B 17/064 428/142
2011/0198378 A1 8/2011 Chang et al.
2011/0311320 A1 12/2011 Schilp et al.
2012/0247154 A1* 10/2012 Abramov ..... C03B 33/0235 65/54
2013/0126576 A1* 5/2013 Marshall ..... C03B 33/033 225/2
2013/0134198 A1* 5/2013 Hill ..... C03B 33/0215 225/2

FOREIGN PATENT DOCUMENTS

JP 2012187453 A 10/2012
KR 20030053390 A 6/2003
KR 20100057530 A 5/2010
KR 20110095191 A 8/2011

OTHER PUBLICATIONS

International Search Report for Application No. PCT/KR2014/010479 dated Mar. 2, 2015.

* cited by examiner

ROLL MANUFACTURING METHOD AND MANUFACTURING DEVICE

CROSS-REFERENCE TO RELATED APPLICATION

This application is a national phase entry under 35 U.S.C. § 371 of International Application No. PCT/KR2014/010479, filed Nov. 4, 2014, published in Korean, which claims priority to Korean Patent Application No. 10-2013-0133104, filed on Nov. 4, 2013, the disclosures of which are incorporated herein by reference.

BACKGROUND OF THE INVENTION

Field of the Invention

The present invention relates to a method and apparatus for manufacturing a roll, and more particularly, to a method and apparatus for manufacturing a roll able to prevent a web from coming into contact with the surface of equipment through ultrasonic vibrations, thereby preventing the possibility of defects occurring in the web.

Description of Related Art

As display devices become thinner and lighter, glass substrates are also becoming thinner. Due to the continuing trend for thinner device profiles, the thickness of substrates has changed from the existing thickness of 0.7 mm to a currently-preferred thickness of 0.5 mm or less. At a substrate thickness of 0.3 mm or less, difficulties in transportation become higher, as compared to existing sheet types. This consequently decreases yield and limits productivity. Accordingly, an approach of applying a roll-to-roll process, a process that has commonly been used in the film industry, to the manufacturing of substrates was proposed in order to improve productivity and respond to the trend for thinner substrate profiles.

Currently in the film industry, roll-to-roll systems typically use contact transportation to transport a web since the surface quality of the web is not an important factor in this industry. However, in the glass substrate industry to which the present invention relates, the surface quality of a glass substrate is an important factor, and the quality of a product may be adversely influenced by surface scratches, contaminants or substrate damage that could result from the contact transportation.

An existing approach for avoiding such problems includes attaching or applying a separate release material to a substrate. However, this approach requires separate equipment to be added, making the process complicated and increasing equipment costs. In addition, the additional attached or applied material is continuously consumed, contributing to an increase in the price of products.

A non-contact transportation approach using air floatation was introduced in order to overcome the drawbacks of the above-mentioned transportation through contact. However, the air floatation scheme may cause problems when applied to the transportation of a thin glass web. Considering the material properties of the thin glass web, the air floatation may have significant dynamic effects on the thin glass web due to external vibrations. In addition, the thin glass web is a brittle material that easily breaks. For example, the air floatation has difficulties in terms of control of a flow of fluid and is influenced by turbulence, thereby resulting in the transportation of the glass web being unstable. Consequently, the glass web may come into contact with the surface of the system, or variations in the lateral position of the glass web may increase when the glass web is being wound. In addition, when air is contaminated, the surface of the glass web may also be contaminated, leading to an adverse effect on the quality of a resultant product. Furthermore, since a predetermined pressure of filtered air must be continuously fed, a significant utility cost is caused, thereby increasing manufacturing costs.

In addition, if the process is elongated, the connection of pipes for supplying the floating air becomes more complicated, thereby increasing initial equipment investment costs.

In an operation of processing a web (e.g. cutting, polishing, shaping, printing on, or coating the web), more particularly, in a thin web processing operation, the web may vibrate for a variety of reasons, such as mechanical vibrations. In some cases, the web may vibrate undesirably through resonance. Such vibrations of the web not only generate noise, but also become a factor in lowering and degrading several types of processing precision. Such vibrations also cause adverse effects not only on the operation of processing the web, but also on the precision of the operations of examining, measuring, controlling, or transporting the web.

Vibration suppressing methods of the related art include a method of suppressing vibrations in a non-contact manner using a flow of fluid (high-pressure air) (Korean Patent Application Publication No. 10-2003-0053390, titled "DEVICE FOR SUPPRESSING VIBRATION OF STEEL SHEET IN NON-CONTACT MANNER IN CONTINUOUS STEEL MAKING LINE"). However, according to this method, it is critically difficult to uniformly adjust the height of the web using only the rate of air flow, and the force maintaining the web in a non-contact state is very weak. Thus, the web tends to touch the device when the web is in an unstable state (e.g. trembling) (Korean Patent Application Publication No. 10-2011-0095191, titled "NON-CONTACT DANCER MECHANISM").

BRIEF SUMMARY OF THE INVENTION

Various aspects of the present invention provide a method and apparatus for manufacturing a roll able to prevent a web from coming into contact with the surface of equipment through ultrasonic vibrations, thereby preventing the possibility of defects occurring in the web, and able to improve transportation quality for the web based on the reliable floating force of ultrasonic waves.

Also provided are a method and apparatus for manufacturing a roll able to suppress vibrations occurring during a web processing operation while reliably maintaining the web in a non-contact state by applying uniform pressure onto the glass web Without mechanical contact.

In an aspect of the present invention, provided is a method of manufacturing a roll that includes the following operations of: shaping a raw material into a web; transporting the shaped web; suppressing vibrations of the web using a vibration suppressing unit disposed on at least one point of a path along which the web is transported; and winding the transported web into a roll. The vibration suppressing unit includes a first ultrasonic vibrator and a second ultrasonic vibrator spaced apart from and facing each other such that the web is disposed therebetween. The first ultrasonic vibrator and the second ultrasonic vibrator hold the web therebetween in a non-contact manner by generating ultrasonic vibrations and applying repelling force induced from the ultrasonic vibrations onto the web, thereby suppressing vibrations of the web.

In another aspect of the present invention, provided is an apparatus for manufacturing a roll that includes: a shaping unit shaping a raw material into a web; a transportation unit transporting the shaped web; a vibration suppressing unit disposed on at least one point of a path along which the web is transported to suppress vibrations of the web; and a winding unit winding the transported web into a roll.

According to the present invention as set forth above, it is possible to prevent a web from coming into contact with the surface of equipment through ultrasonic vibrations, thereby preventing the possibility of defects occurring in the web, and able to improve transportation quality for the web based on the reliable floating force of ultrasonic waves.

In addition, it is possible to reliably perform a plurality of operations on a web, including processing, examination, measurement, control and transportation, by preventing defects from occurring in the web by mechanical contact and suppressing vibrations of the web.

DETAILED DESCRIPTION OF THE INVENTION

Figure 1:
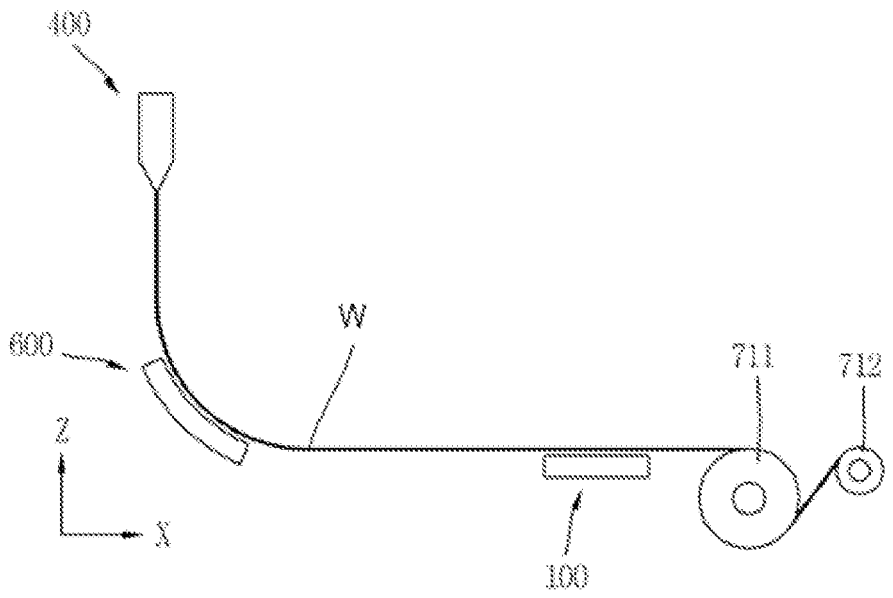
FIG. 1 is a schematic side-elevation view illustrating a first exemplary embodiment of an apparatus for manufacturing a roll according to the invention.

Reference will now be made in detail to embodiments of the present invention in conjunction with the accompanying drawings and described below, so that a person skilled in the art to which the present invention relates could easily put the present invention into practice.

Throughout this document, reference should be made to the drawings, in which the same reference numerals and signs are used throughout the different drawings to designate the same or similar components. In the following description of the present invention, detailed descriptions of known functions and components incorporated herein will be omitted in the case that the subject matter of the present invention is rendered unclear.

FIG. 1 is a schematic side-elevation view illustrating a first exemplary embodiment of an apparatus for manufacturing a roll according to the invention.

The apparatus for manufacturing a roll illustrated in FIG. 1 includes a shaping unit 400, a transportation unit 100, a redirection unit 600 and a winding unit.

The shaping unit 400 shapes a raw material into a glass web W. The redirection unit 600 changes the direction in which the glass web W is transported. On the paper surface of FIG. 1, the redirection unit 600 changes the direction of transportation from a vertically downward direction to a horizontal direction. Specifically, the glass web W shaped in the shaping operation is transported vertically downward to arrive at the redirection unit 600 that is disposed on the path along which the glass web W is transported. The direction of transportation of the glass web W is changed from the vertically downward direction to the horizontal direction by the redirection unit 600. The winding unit winds the transported web W into a roll. The winding unit includes a protective film reel 712 from which a protective film is unwound and a winding reel 711 on which the glass web W is wound together with the protective film.

While the glass web W is typically a glass web, the present invention is not limited thereto and the glass web W can be formed of a variety of other materials. The present invention relates to a method and apparatus for manufacturing a web, more particularly, a thin glass web in the shape of a roll. Still more particularly, the present invention relates to a method and apparatus for manufacturing a glass roll using non-contact transportation.

For this, the present invention provides a non-contact web transportation device using ultrasonic waves. A glass web W manufactured using a glass substrate shaping device based on a fusion draw process or a floating process is transported in a non-contact manner using a non-contact ultrasonic technology disclosed in Korean Patent Application Publication No. 10-2010-0057530, and is finally formed as a glass roll.

Since the glass web W shaped in the shaping unit 400 is transported without contact with equipment and is finally wound on the glass roll, it is possible to manufacture the glass roll without surface damage or contamination. The glass web W or glass sheets produced therefrom can be used in a variety of fields, such as displays, electronic materials (e.g. photovoltaic cells, touch sensors and wafers), construction and home appliances.

Figure 2:
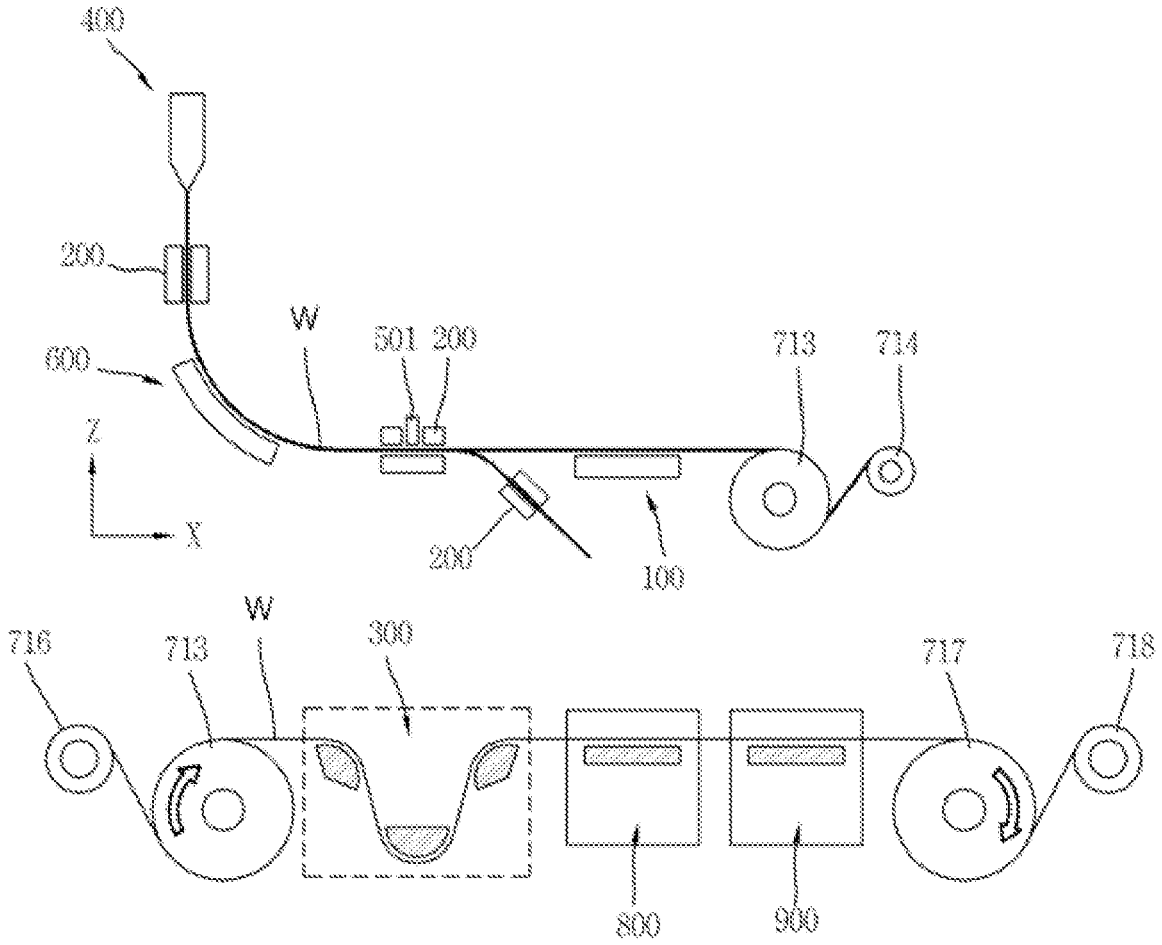
FIG. 2 is a schematic side-elevation view illustrating a second exemplary embodiment of the apparatus for manufacturing a roll according to the invention.

FIG. 2 is a schematic side-elevation view illustrating a second exemplary embodiment of the apparatus for manufacturing a roll according to the invention.

In order to manufacture a glass roll, the apparatus for manufacturing a roll includes a vibration suppressing unit 200 configured to safely transport a glass web W transported vertically downward from the shaping unit 400 and prevent the glass shaping operation from being influenced by downstream vibrations. It is preferable that the vibration suppressing unit 200 suppresses vibrations of the glass web W by applying the repelling force of a high-pressure air layer induced from ultrasonic vibrations onto the glass web W shaped in the shaping unit 400 before the glass web W is cooled to a temperature below the softening temperature thereof. Since vibrations have a significantly adverse effect on the quality of the glass web W when transferred to the glass web W at a temperature below the softening temperature thereof, it is necessary to suppress vibrations of the glass web W before being cooled below the softening temperature thereof.

The apparatus for manufacturing a roll further includes the redirection unit 600 for redirecting a glass web in a non-contact manner in order to transport the glass web W that has moved vertically downward.

After the direction of transportation of the glass web W is changed to a horizontal direction, the glass web W passes through a cutting unit 501. The cutting unit 501 cuts the glass web W, preferably, using a laser in a non-contact manner. In order to help the cutting be reliable, the vibration suppressing unit 200 applies repelling force induced from ultrasonic vibrations onto at least one of both adjacent portions of the web that are lengthwise adjacent to a cut portion that is being cut. FIG. 2 illustrates an embodiment in which the repelling force is applied to both adjacent portions that are lengthwise adjacent to the cut portion that is being cut.

The vibration suppressing unit 200 is disposed on at least one point of the path along which the trimmed portion cut by the cutting unit 501 is discharged separately from the glass web W in order to suppress vibrations of the trimmed portion.

The glass web W from which the trimmed portion is separated is wound on an intermediate reel 713 as a glass roll.

Afterwards, the glass web can be unwound from the intermediate reel 713, transported in a non-contact manner, and wound on a winding reel as a glass roll, thereby forming the glass roll from the glass web W without damage thereto. The operation of winding the glass web W on the intermediate reel 713 and the operation of unwinding the glass web W from the intermediate reel 713 can be carried out discontinuously or separately. The operation of unwinding the protective film from the protective film reel 714 and the operation of winding the protective film on the protective film reel 716 can be carried out discontinuously or separately. The protective film reel 714 and the protective film reel 716 can be the same as or different from each other. In some cases, (i) a set of operations from the operation of shaping the glass web W to the operation of wining the glass web W on the intermediate reel and (ii) a set of operations from the operation of unwinding the glass web W from the intermediate reel to the operation of winding the glass web W on the winding reel can be carried out by different parts.

The apparatus for manufacturing a roll further includes a non-contact tension adjustment unit 300 that can adjust the tension of the glass web W while absorbing the torsion of the glass web W. The tension adjustment unit 300 is disposed on at least point of the path along which the glass web W is transported.

In addition, the transportation unit 100 includes an ultrasonic vibration unit and a contact transportation unit. The contact transportation unit transports at least one point of the glass web W floated by the ultrasonic vibration unit in contact with the at least one point of the glass web W, thereby increasing the reliability of transportation. The contact transportation unit may include, for example, a belt or clamps.

The apparatus for manufacturing a roll illustrated in FIG. 2 further includes the redirection unit 600, the cutting unit 501, the vibration suppressing unit 200, the tension adjustment unit 300, a cleaning unit 800 and an examination unit 900, in addition to the shaping unit 400, the transportation unit 100 and the winding unit.

Figure 3:
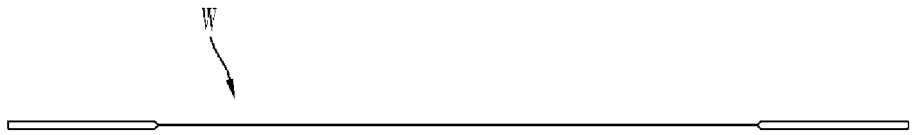
FIG. 3 is a cross-sectional view of a web formed using the shaping unit illustrated in FIG. 1 and FIG. 2, viewed along the width of the web.

When the shaping unit 400 forms the glass web W using the fusion draw process, the glass web W is formed in the Z axis direction. As illustrated in FIG. 3, the thickness of the opposite lateral edges of the glass web W is greater than the thickness of the central portion of the glass web W. The thinner central portion of the glass web W is used as a product, whereas the non-effective both edge portions of the glass web W are separated and removed from the glass web W using the cutting unit 501.

Figure 4:
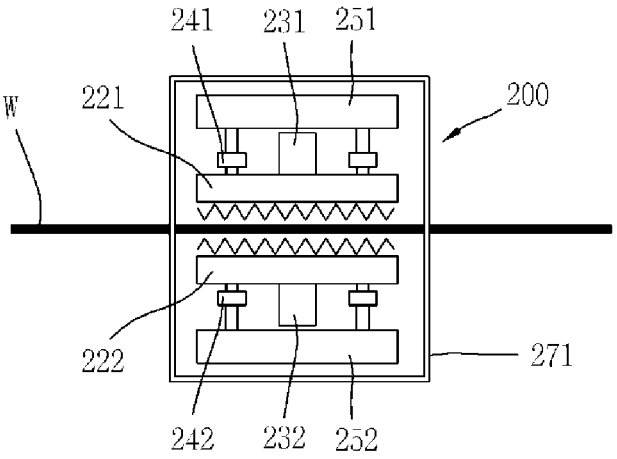
FIG. 4 schematically illustrates the principle of suppressing vibrations using the vibration suppressing unit illustrated in FIG. 2.

The glass web W may, for example, tremble influenced by downstream vibrations or external air currents while being formed using the shaping unit 400. In this case, the glass may have an unstable shape or break. Accordingly, the vibration suppression unit 200 is disposed inside or downstream of the shaping unit 400. As illustrated in FIG. 4, the vibration suppression unit 200 includes first and second ultrasonic wave generators 231 and 232 disposed on both sides of the glass web W such that they face both surfaces of the glass web W in order to prevent the glass web W from vibrating in the thickness direction of the glass web W in a non-contact manner. Ultrasonic wave generators 231 and 232 are configured to vibrate the ultrasonic vibrators 221 and 222. Vibration absorbers 241 and 242 prevent the vibrations of ultrasonic vibrators 221 and 222 from leaking to the outside such that no parts other than the glass web W are influenced by the vibrations of the ultrasonic vibrators 221 and 222. Fixing frames 251 and 252 support the ultrasonic vibrators 221 and 222 at fixed positions. A shell 271 encloses inner parts of the vibration suppressing unit 200.

After the glass web W is manufactured in this manner, the direction in which the glass web W is transported is changed using a non-contact glass web redirection unit illustrated in FIG. 5 to FIG. 8. When a manufacturing site is sufficiently high, the glass web W can be continuously transported in the Z axis direction without the redirection unit.

Figure 5:
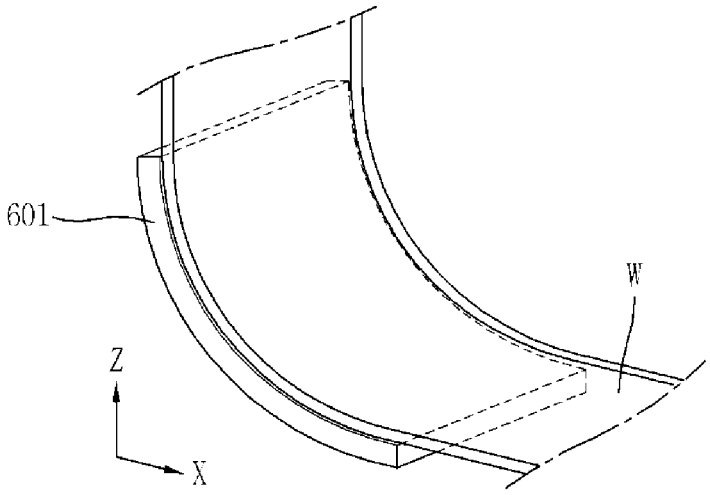
FIG. 5 schematically illustrates the redirection unit illustrated in FIG. 1 and FIG. 2.
Figure 6:
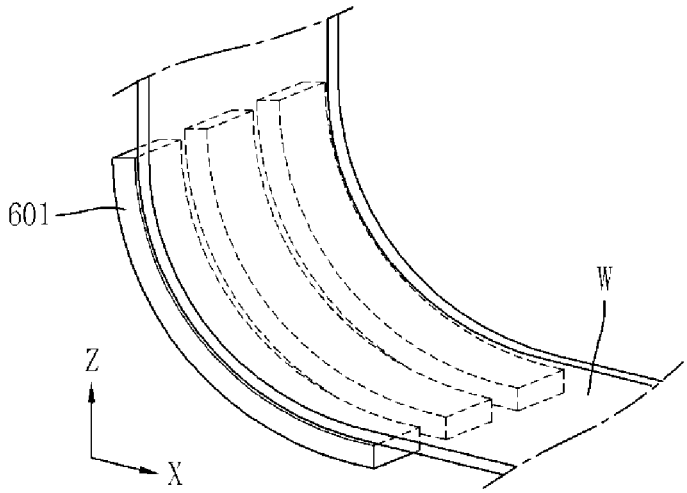
FIG. 6 to FIG. 8 schematically illustrate other embodiments of the redirection unit.
Figure 7:
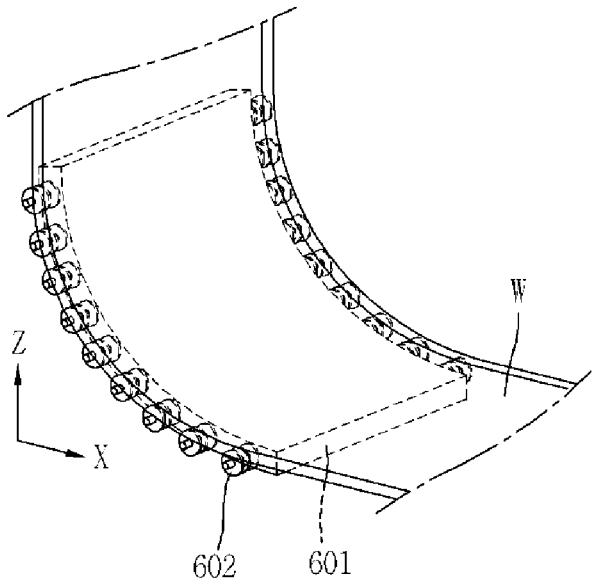
Figure 8:
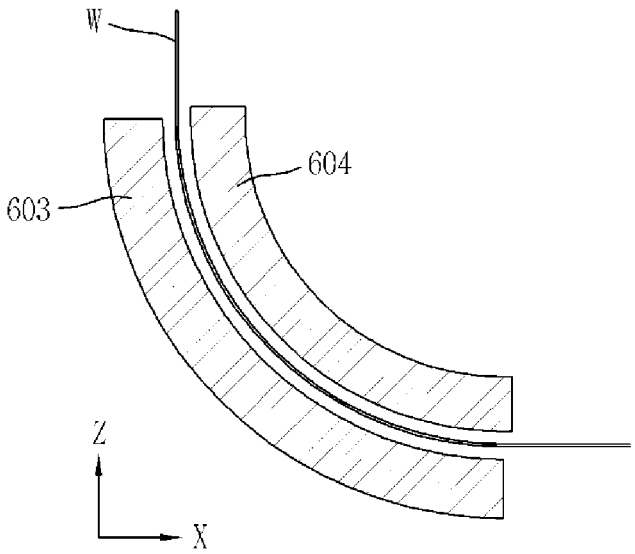

The redirection unit 600 is a device for changing the direction of the glass web W from the Z axis to the X axis without contact with the glass web W using a non-contact ultrasonic technology. As illustrated in FIG. 5, the redirection unit 600 includes a non-contact transportation unit 601. It is possible to support the glass web W in a non-contact manner by applying floating force onto the glass web W in a non-contact manner by applying the repelling force of a high-pressure air layer induced from ultrasonic vibrations onto the entire area of a curved section of the glass web W. As illustrated in FIG. 6, it is possible to provide a non-contact support to predetermined portions of the curved section of the glass web W along the width in order to reduce equipment costs. As illustrated in FIG. 7, it is also possible to combine the non-contact transportation unit 601 with a contact transportation unit 602. The contact transportation unit 602 transports at least one point of the glass web W floated by the non-contact transportation unit 601 while keeping in contact with the at least one point. The contact transportation unit 602 can be disposed to contact the ineffective area of the glass web W in order to more reliably transport the glass web W. The effective area refers to a usable area of the glass web W or a glass sheet produced therefrom, whereas the ineffective area indicates an unusable area. For example, when the glass web W is cut along the width and subsequently is used as a display glass substrate, the effective area forms an usable area, i.e. a display area, whereas the ineffective area forms an unusable area or a non-display area, i.e. a peripheral area through which screen light does not pass. Here, the contact transportation unit 602 may be implemented as rollers, a belt or clamps. In addition, as illustrated in FIG. 8, the redirection unit 600 can be implemented as a vibration suppressing unit including first and second ultrasonic vibrators 603 and 604 that face each other. The first and second ultrasonic vibrators 603 and 604 can prevent vibrations from the downstream from being transferred to the shaping unit and guide the glass web W such that the transportation direction of thereof can be more efficiently changed.

Figure 9:
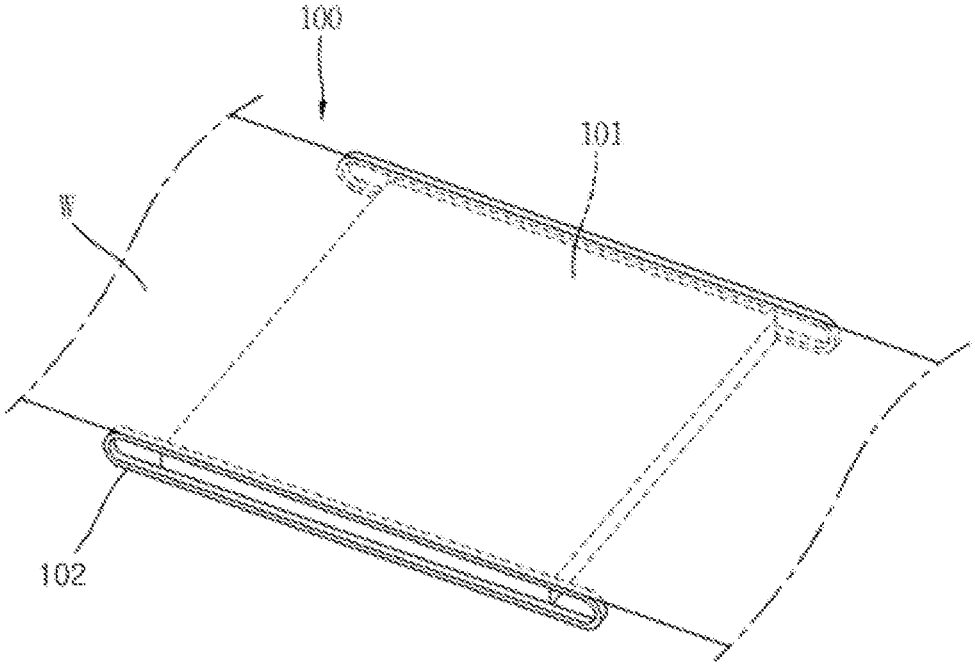
FIG. 9 schematically illustrates the transportation unit.

After the transportation direction of the glass web W is changed, the glass web W is transported by the transportation unit 100. The transportation unit 100 is disposed on at least one point of the path along which the glass web W is transported. The transportation unit 100 includes a non-contact transportation unit 101, as illustrated in FIG. 9. The non-contact transportation unit 101 can support the entire area or a portion of a corresponding section of the glass web W. The non-contact transportation unit 101 applies floating force onto the glass web W in a non-contact manner by generating ultrasonic vibrations and applying the repelling force of a high-pressure air layer induced from the ultrasonic vibrations onto the glass web W. In addition, as illustrated in FIG. 9, the transportation unit 100 may further include a contact transportation unit 102 as required. The contact transportation unit 102 transports at least one point of the glass web W floated by the non-contact transportation unit 101 while keeping in contact with the at least one point. It is preferable that the contact transportation unit 102 contacts only a portion of the glass web within a predetermined length from the opposite lateral edges of the glass web. It is preferable that the contact transportation unit 102 contacts the portion to be trimmed away before the trimming and subsequently the ineffective area after the trimming. Here, it is preferable that the width of the portion to be contacted is less than 10 mm. The non-contact transportation unit 101 floats the effective area by applying repelling force onto the effective area.

In general, the contact transportation unit 102 may contact the opposite lateral edges of the glass web. In the case that the contact transportation unit 102 contacts the opposite lateral edges of the glass web, if the synchronization in the transportation speed between two parts of the contact transportation unit 102 is failed, the glass web may skid or break through distortion. In order to prevent it, the contact transportation unit 102 can be disposed on only one of the lateral edge portions. It is possible to transport the glass web W even in the case that a small area of the glass web W is in contact with the contact transportation unit 102, since the glass web W is floated by the non-contact transportation unit 101.

As illustrated in FIG. 1, the cutting unit 501 is disposed on at least one point of the path along which the glass web W is transported. The cutting unit 501 cuts the glass web W using a mechanical cutting scheme or a laser cutting scheme. A typical example of the laser cutting scheme includes creating an initial crack on the glass web W, locally heating the glass web W, and subsequently propagating the crack by cooling.

Since it is required to stably transport the glass web W during the cutting operation, the vibration suppressing unit 200 may be disposed on at least one point of an upstream point and a downstream point adjacent to the cutting unit 501. This configuration can prevent the cutting operation or the like from being influenced by vibrations or waves of the glass web W that would otherwise be transferred to the cutting unit 501 from the upstream and/or the downstream of the cutting unit. The trimmed portions separated from the glass web W by the cutting unit 501 are discharged in a different direction from the glass web W and are subsequently crushed. Since vibrations occurring during the crushing of the trimmed portions may have adverse effect on the cutting unit 501 when they are transferred backwards through the trimmed portions, the vibration suppressing unit 200 is provided to prevent the vibrations from being transferred. The vibration suppressing unit 200 may be a non-contact vibration suppressing unit or a contact vibration suppressing unit.

The vibration suppressing unit 200 is disposed on at least one point of the path along which the glass web W is transported in order to suppress vibrations of the glass web W. As illustrated in FIG. 4, the vibration suppressing unit 200 includes the first ultrasonic vibrator 221 and the second ultrasonic vibrator 222. The vibration suppressing unit 200 may also include the ultrasonic wave generators 231 and 232, the vibration absorbers 241 and 242, the fixing frames 251 and 252, and the shell 271. The first ultrasonic vibrator 221 and the second ultrasonic vibrator 222 are spaced apart from and face each other such that the glass web W can be disposed therebetween. The first ultrasonic vibrator 221 and the second ultrasonic vibrator 222 hold the glass web W therebetween by generating ultrasonic vibrations and applying repelling force induced from the ultrasonic vibrations onto the glass web W, thereby suppressing vibrations of the glass web W.

The glass web W from which the trimmed portions are separated is transported again by the non-contact transportation unit 101, and subsequently is wound on the intermediate reel 713 as a glass roll. When the glass web is wound on the intermediate reel 713, turns of the glass web W may contact each other, forming scratches thereon. In order to prevent this, the glass web W may be wound together with the protective film which has been unwound from the protective film reel 714 such that the glass web W is covered with the protective film, thereby forming a roll of the glass web W and the protective film.

When the glass roll is manufactured, a separate processing operation may be undertaken using a roll-to-roll process. As illustrated in FIG. 2, the roll-to-roll process starts with the operation of unwinding the glass web W from the glass roll. In the unwinding operation, the protective film is recovered from the glass web such that it can be input into the processing of the glass web W that is bare. As illustrated in FIG. 2, the glass web W passes through the tension adjustment unit 300 as required. A dancer of the tension adjustment unit 300 includes a non-contact ultrasonic vibrator. The ultrasonic vibrator can adjust the tension of the glass web B in a non-contact manner by applying the repelling force of a high-pressure air layer induced from ultrasonic vibrations onto the glass web W.

Figure 10:
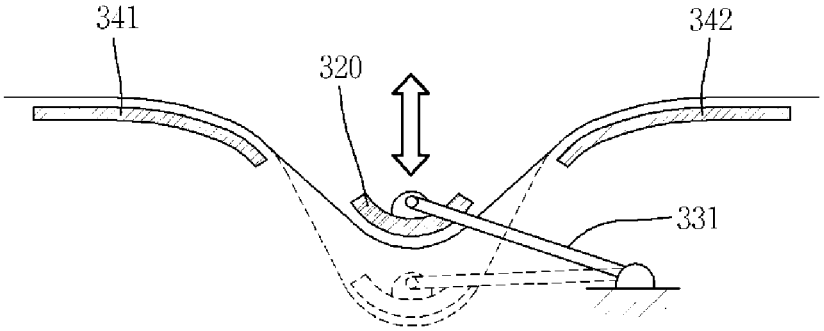
FIG. 10 schematically illustrates the principle of adjusting tension using the tension adjustment unit illustrated in FIG. 2.

As illustrated in FIG. 10, a non-contact dancer 320 may be added in order to control the tension of the glass web W and the speed at which the glass web W is transported. The dancer 320 can control the tension of the glass web W by continuously applying a predetermined amount of force onto the glass web W from the outside such that the glass web W remains under constant tension. For the purpose of speed control, when one of an unwinding side and a winding side is a master and the other is a slave, it is possible to control the difference between the unwinding speed and the winding speed to synchronize the speeds in real time by increasing and decreasing the winding speed of the slave by measuring and feedbacking the height of the dancer 320 in real time.

The tension adjustment unit 300 illustrated in FIG. 10 includes the dancer 320, a link 331 and supports 341 and 342.

The glass web W may undergo a cleaning operation and an examination operation. For this, the cleaning unit 800 and an examination unit 900 are disposed at predetermined points on the path along which the glass web W is transported. The cleaning unit 800 cleans the glass web W, whereas the examination web 900 examines the glass web W. In addition, other operations may be added as required. The non-contact transportation can be carried out, preferably, using the ultrasonic non-contact transportation unit 101 through these operations.

Finally, the winding unit winds the glass web W on a winding reel 717 together with a protective film which has been unwound from a protective film reel 718 such that the glass web W is covered with the protective film, thereby forming a roll of the glass web W and the protective film.

What is claimed is:

1. A method of manufacturing a roll comprising:

shaping a raw material into a web;

transporting the shaped web;

suppressing vibrations of the web using a first vibration suppressing unit disposed on at least a first point of a path along which the web is transported;

winding the transported web into a roll, wherein the first vibration suppressing unit comprises a first ultrasonic vibrator and a second ultrasonic vibrator spaced apart from and facing each other such that the web is disposed therebetween, wherein the first ultrasonic vibrator and the second ultrasonic vibrator hold the web therebetween in a non-contact manner by generating ultrasonic vibrations and applying repelling force induced from the ultrasonic vibrations onto the web such that uniform pressure is applied onto the web, thereby suppressing vibrations of the web.

2. The method according to claim 1, further comprising cleaning the web using a cleaning unit and/or examining the web using an examining unit, the cleaning unit and the examining unit being disposed on at least one point of the path along which the web is transported.

3. The method according to claim 2, further including the step of trimming away an edge portion of the web using a cutting unit disposed on at least one point of the path along which the web is transported before cleaning and/or examining the web; and intermediately winding the web on an intermediate reel and intermediately unwinding the web from the intermediate reel between trimming away the edge portion of the web and cleaning and/or examining the web, wherein intermediately winding the web is discontinuously followed by intermediately unwinding the web.

4. The method according to claim 1, wherein the web shaped from the raw material is transported vertically downward to arrive at a redirection unit disposed on the path along which the web is transported, and subsequently is transported horizontally, with a direction of transportation of the web being changed from a vertically downward direction to a horizontal direction by the redirection unit.

5. The method according to claim 4, wherein the redirection unit comprises a non-contact transportation unit, wherein the non-contact transportation unit applies floating force onto the web in a non-contact manner by generating ultrasonic vibrations and applying repelling force induced from the ultrasonic vibrations onto the web.

6. The method according to claim 5, wherein the redirection unit further comprises a contact transportation unit, wherein the contact transportation unit transports at least one point of the web floated by the non-contact transportation unit while keeping in contact with the at least one point of the web.

7. The method according to claim 4, wherein the redirection unit comprises a third ultrasonic vibrator and a fourth ultrasonic vibrator spaced apart from and facing each other such that the web is disposed therebetween, wherein the third ultrasonic vibrator and the fourth ultrasonic vibrator hold the web therebetween in a non-contact manner by generating ultrasonic vibrations and applying repelling force induced from the ultrasonic vibrations onto the web, thereby suppressing vibrations of the web.

8. The method according to claim 1, wherein winding the web into the roll comprises winding a protective film which has been unwound from a protective film reel on a winding reel together with the web such that the web covered with the protective film is wound into the roll.

9. The method according to claim 1, further comprising adjusting a tension of the web using a tension adjustment unit disposed on at least one point of the path along which the web is transported.

10. The method according to claim 1, wherein the web comprises a thin glass web.

11. The method according to claim 1, wherein transporting the web comprises transporting the web using a transportation unit disposed on at least one point of the path along which the web is transported, the transportation unit comprising a non-contact transportation unit and a contact transportation unit, wherein at least a portion of the contact transportation unit overlaps the non-contact transportation unit along the path of the web transport, wherein the non-contact transportation unit applies floating force onto the web in a noncontact manner by generating ultrasonic vibrations and applying repelling force induced from the ultrasonic vibrations onto the web, and the contact transportation unit transports at least one point of the web floated by the non-contact transportation unit along the path while keeping in contact with the at least one point of the web.

12. The method according to claim 11, wherein the web comprises an effective area and an ineffective area, and the non-contact transportation unit floats the effective area by applying the floating force onto the effective area, and the contact transportation unit comes into contact with the ineffective area.

13. The method according to claim 1, further comprising trimming away an edge portion of the web using a cutting unit disposed on at least one point of the path along which the web is transported.

14. The method according to claim 13, wherein trimming away the edge portion comprises laser cutting in which the web has no contact with the cutting unit.

15. The method according to claim 13, wherein the step of suppressing vibrations includes suppressing vibrations using a second vibration suppressing unit disposed on a second point of the path along which the web is transported, wherein the second vibration suppressing unit applies the repelling force induced from the ultrasonic vibrations onto at least one of both adjacent portions of the web that are lengthwise adjacent to a cut portion of the web that is being cut.

16. The method according to claim 15, further including a third vibration suppressing unit disposed on a third point of the path along which the web is transported, wherein the third vibration suppressing unit suppresses the vibrations of the web by applying the repelling force induced from the ultrasonic vibrations onto the web before the web shaped from the raw material is cooled to a temperature below a softening temperature thereof.

17. The method of claim 13, wherein the first vibration suppressing unit is disposed on a first point of a path along which the edge portion trimmed away and separated from the web by the cutting unit is discharged in order to suppress vibrations of the trimmed portion.

* * * * *